United States Patent [19]

Berger et al.

[11] 3,988,527

[45] Oct. 26, 1976

[54] WALL LEAD-THROUGHS FOR LIVE FEEDERS

[75] Inventors: Robert Berger, Ennetbaden; Hans-Jacob Gloor, Wettingen; Wilhelm Tschol, Fislisbach, all of Switzerland

[73] Assignee: BBC Brown Boveri & Company Limited, Baden, Switzerland

[22] Filed: Feb. 11, 1975

[21] Appl. No.: 549,056

[30] Foreign Application Priority Data

Feb. 19, 1974 Switzerland ..... 2256/74

[52] U.S. Cl. ..... 174/142; 174/152 A; 343/885; 343/905

[51] Int. Cl.[2] ..... H01B 17/26; H01Q 1/50

[58] Field of Search ..... 174/48, 139, 140 R, 174/140 CR, 142, 151, 211, 138 A, 152 A, 153 A; 343/700, 841, 878, 885, 905

[56] References Cited

UNITED STATES PATENTS

| | | | |
|---|---|---|---|
| 3,484,542 | 12/1969 | Mathes et al. | 174/142 |

FOREIGN PATENTS OR APPLICATIONS

| | | | |
|---|---|---|---|
| 1,079,134 | 4/1960 | Germany | 174/139 |
| 158,932 | 2/1921 | United Kingdom | 174/140 R |
| 238,545 | 2/1926 | United Kingdom | 174/142 |

*Primary Examiner*—Laramie E. Askin
*Attorney, Agent, or Firm*—Pierce, Scheffler & Parker

[57] ABSTRACT

A wall lead-through structure for live feeders, particularly for use in antenna matching systems. The feeder is led through a wall opening which is covered on its outer side by an insulating mounting fixture which provides a centrally located opening for the feeder lead-through. The surface defining the wall opening is covered with a sheet metal lining, preferably sheet copper which serves as a corona protector, and a metallic corona protector encloses and is secured to the live feeder where it passes through the central opening in the insulating mounting fixture.

5 Claims, 5 Drawing Figures

WALL LEAD-THROUGHS FOR LIVE FEEDERS

Figure 1:
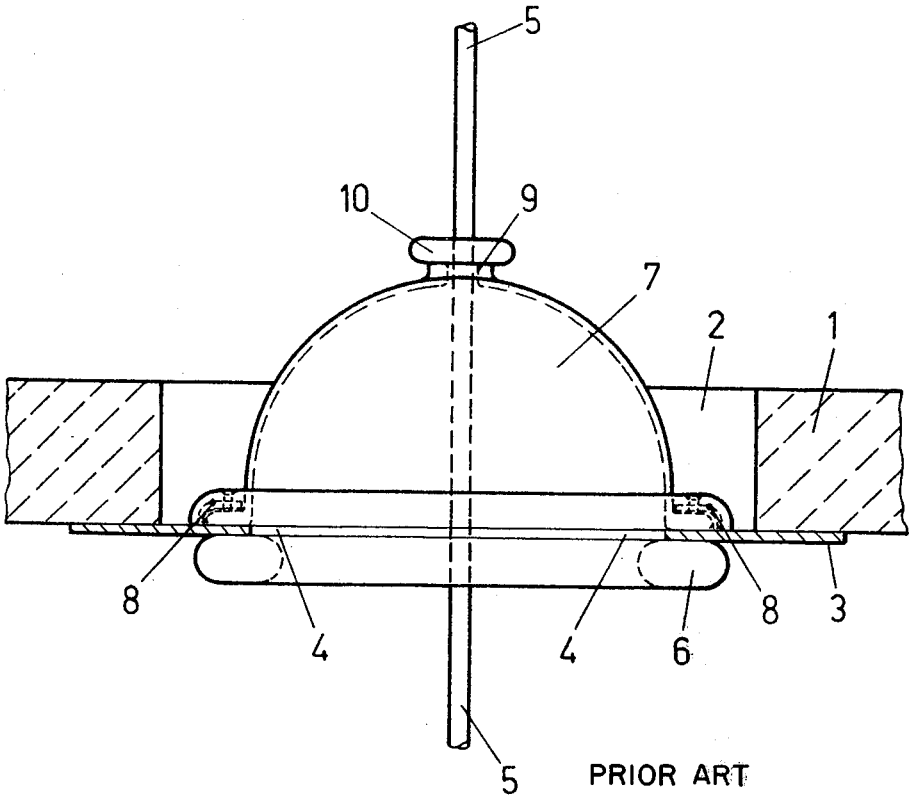

The invention presented herewith concerns a wall lead-through for live feeders, and in particular for antenna matching systems.

Up to now, with wall lead-throughs of the before-mentioned type with which, for example, feeders are to be led out of buildings to the antenna installations, insulators made of ceramic, glass, earthenware or other burnt earth with a smooth or ribbed outer surface, through which the feeders were led and which exhibited different forms as for example semi-spherical, cylindrical or conical were erected on the building walls. These well known types of execution were very expensive, especially for lead-throughs for high tension feeders; the danger of breakage was very high and for the larger types a corresponding sensitivity to transport existed. With various insulator forms a reduction of the dielectric strength due to excessive soiling of the outer surface was observed. Further the mechanical erection, in particular for the larger types, was both critical and time consuming, strong mounting fixtures being required, the weight of these insulator types being relatively high.

It is the assignment of the invention in question to conceive a wall lead-through for live feeders, which is simple in the constructional design, which exhibits a minimum danger of breakage, which for the larger types facilitates ease of transportation, which retains its dielectric strength over a long life-span and which can be simply manufactured and erected.

The before-mentioned assignment shall be resolved in accordance with the invention in that a live feeder be led through a wall-opening, which is covered by an insulating mounting fixture and whose interior surfaces are lined with sheet metal, and with the live feeder enclosed by a corona protector at a central lead-through opening.

The advantage of the arrangement complying with the invention lies particularly in that, for example, a wall opening is covered by a mounting fixture, which is composed of an insulating material and which exhibits an opening at its centre through which the live feeder is led. The surface of the wall opening shall be provided with a sheet metal lining, preferably sheet copper, this acting as a corona protector, while the live feeder is enclosed at the lead-through mounting fixture, composed of insulating material, by a metallic corona protector.

To strengthen the mounting fixture, a reinforcing member is fastened on one side of the insulating mounting fixture; and in accordance with a further form of improvement of the invention a tension absorbing device is arranged around the lead-through opening for fastening the live feeder to the exterior of the wall opening.

By means of this tension absorbing device it shall be arrived at, that when the live feeder is stressed as a result of external influences, for example a storm, or by dislocaton in areas exposed to earthquakes, that the feeder always remains exactly in the middle of the wall lead-through, whereby it is not necessary to have a reinforcing member composed of synthetic material on the mounting fixture itself.

In accordance with a further form of improvement of the lead-through arrangement, for antenna matching systems, a dirt collector room is positioned next to a matching room. Lead-throughs are arranged both between these two rooms and on the outward side for the squared off live feeder, whereby the lead-through of the squared off live feeder exhibits between the matching room and the dirt collector room an insulating mounting fixture, a sheet metal lining and a corona protector, whereas the lead-through of the live feeder from the dirt collector room outwards can be comprised of a sheet metal lining and a tension absorbing device.

The advantage of placing a dirt collector room between the matching room and the outward lead-through of the live feeder lies in that it can be thus prevented that, particularly in areas with excessive dust as for example is often the case in desert regions, sand and dust gets into the matching room, where it could cause damage to the matching equipment.

As the lead-through for the live feeder between the matching room and the dirt collector room is exposed to no mechanical stresses whatever, the lead-through for the live feeder can be merely comprised of a mounting fixture composed of insulating material and a corona protector, whereas for the lead-through of the live feeder from the dirt collector room outwards the live feeder is supported by a tension absorbing device. In all cases however, on the lead-through between the matching room and the dirt collector room and from the dirt collector room outwards, a corona protector on the wall openings in the form of a sheet copper lining is necessary.

The drawings show, besides a well-known arrangement, examples of the execution of the subject of the invention in schematic form.

Indicated are:

FIG. 1 One of the lead-through arrangements corresponding to the level of present technical knowledge in the art.

Figure 2:
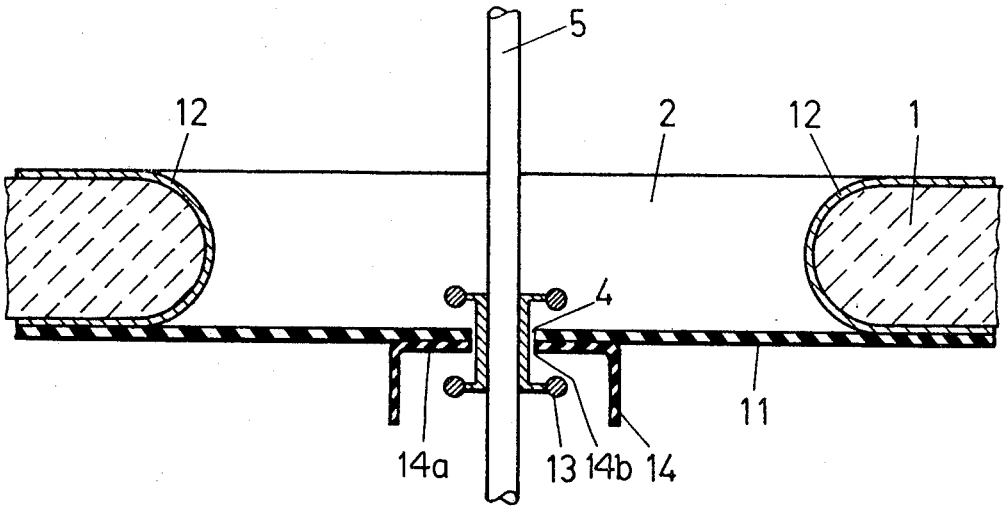

FIG. 2 A lead-through of a live feeder with a mounting fixture and a reinforcing member.

Figure 3:
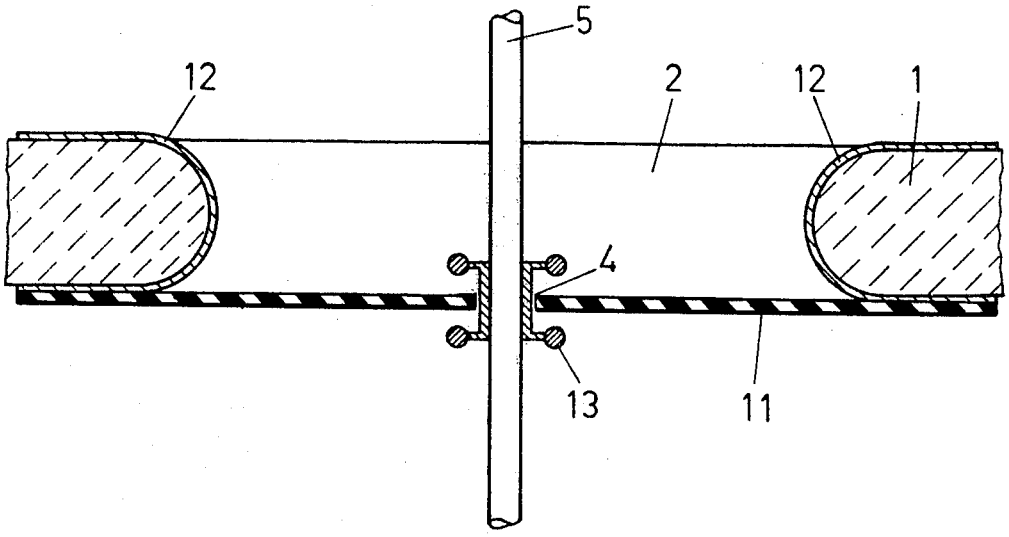

FIG. 3 A lead-through without a reinforcing member.

Figure 4:
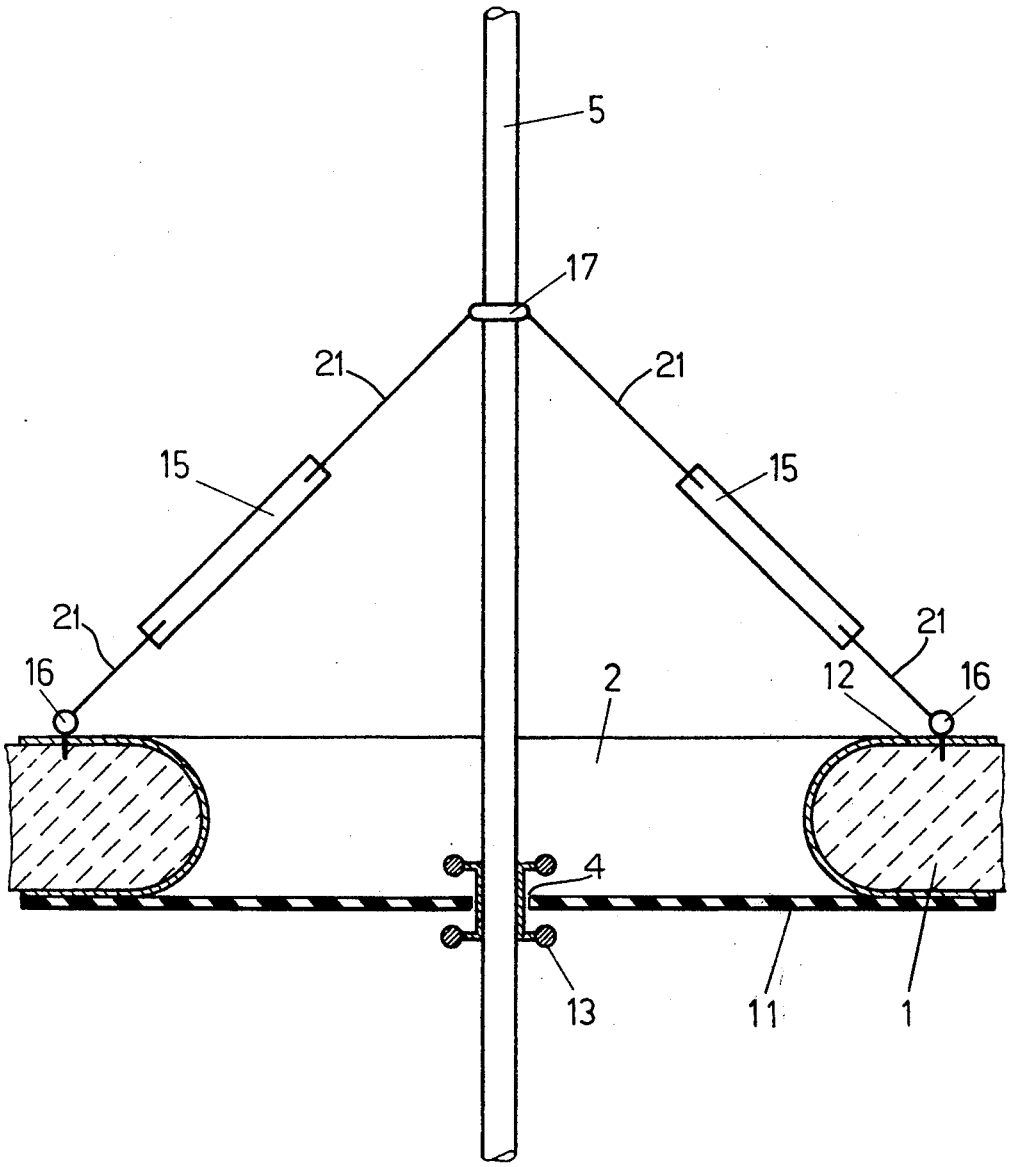

FIG. 4 A lead-through with tension absorbing device.

Figure 5:
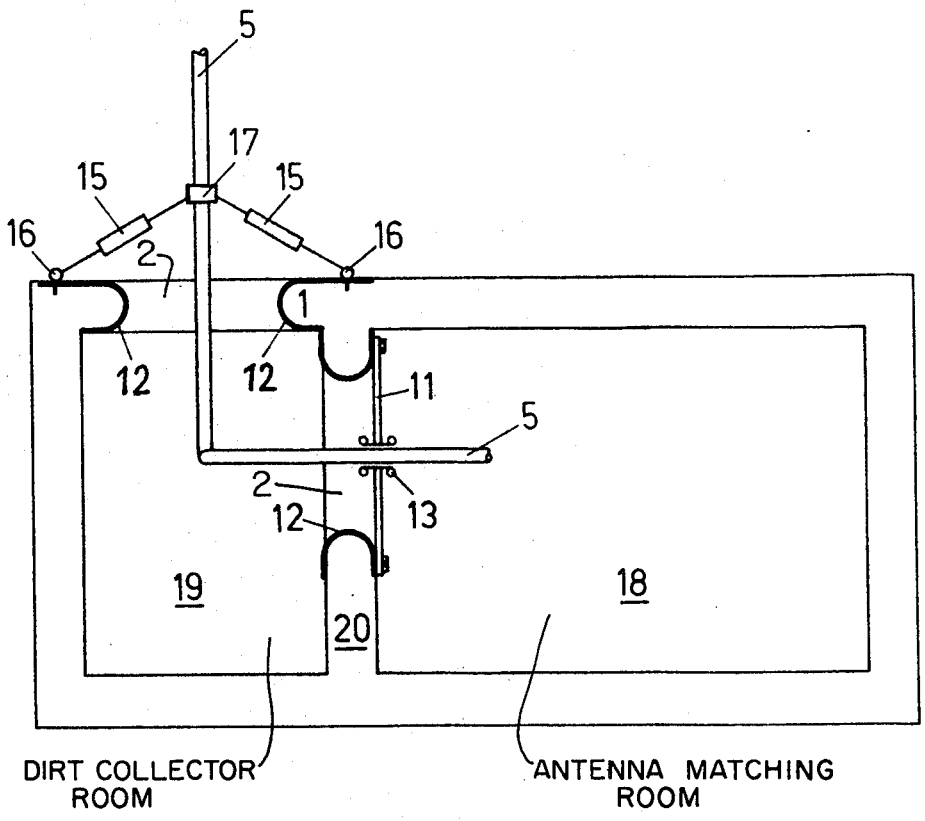

FIG. 5 An arrangement with matching room and dirt collector room.

FIG. 1 shows the hitherto usual method by which an opening 2 is made in the wall 1, which is covered with a metallic mounting fixture 3, this being fastened to the wall in a known manner by means of screws or clamps. The metallic mounting fixture 3 exhibits a central lead-through opening 4 through whose centre a live feeder 5 is led. A corona ring 6 is fastened on the lower surface of the metallic mounting fixture 3. On the opposite surface of the metallic mounting fixture 3, a ceramic insulator, which here for example is in the form of a semi-sphere, is arranged. The ceramic insulator 7 is fixed to the metallic mounting fixture 3 in a known manner by means of a cleat 8 which is comprised of a holding clip with thrust screw. An outer corona protector 10 is mounted on an upper lead-through opening 9 of the ceramic insulator 7.

In conformity with FIG. 2, an opening 2 is made in the wall 1 which is covered on its outward side with an insulating mounting fixture 11 provided with a central lead-through opening 4 for the live feeder 5. The surface of the opening 2 in the wall 1 is covered with a sheet metal lining 12, preferably sheet copper, which serves as a corona protector. A metallic corona protector 13 is fastened onto the live feeder 5 at the central lead-through opening 4 in the insulating mounting fixture 11. For the purpose of mechanically strengthening the plate-form insulating mounting fixture 11 against sag at the wall opening 2 a reinforcing member 14 is mounted on the side facing the inside of the building. The reinforcing member 14 which is made from a synthetic material has a cup-shaped configuration and the bottom wall 14a which is affixed to the mounting plate 11 is provided with a central opening 14b in alignment with and of the same diameter as the lead-through opening 4.

FIG. 3 shows a lead-through for a live feeder which is not insulated, as is often employed with wall openings between individual rooms, where the live feeder and the insulating mounting fixture 11 cannot be influenced by exceptional stresses and strains. Accordingly, the opening 2 in the outer surface of the wall which is lined with the sheet metal lining 12 is covered by the insulating mounting fixture. The central lead-through opening 4 in the insulating mounting fixture 11 exhibits merely the corona protector 13 for the live feeder 5.

For a lead-through for a live feeder from a building to the transmitting antenna, particularly where the live feeder 5 is exposed to high wind velocities or other mechanical stresses and as shown in FIG. 4, the live feeder is additionally supported by an adjustable tension absorbing arrangement including an interposed insulator 15 instead of the reinforcing member 14. The tension absorbing arrangement can, in a known manner, consist of pull-rods, traction ropes or tension springs designated as a group by 21, and is on the one hand anchored to the wall 1 by means of rings 16 which pass through the sheet metal lining 12 on the outer surface of the wall, and on the other hand fastened at a pre-determined distance from the opening 2 on the live feeder 5 by means of a ring-shaped holding device 17.

The arrangement of lead-throughs for live feeders presented in FIG. 5 can be advantageously employed everywhere where excessive dust and dirt is to be encountered, as for example in desert regions. Hereby, a dirt collector room 19 is situated next to a matching room 18, i.e. a room in which the various components for the antenna matching of a transmitter are placed, by which means it will be prevented that sand and dust enter into the individual matching equipment. Thereby, a lead-through for the live feeder 5 is arranged in compliance with FIG. 3 in a dividing wall 20 between the matching room 18 and the dirt collector room 19, the wall 1 with an opening 2 exhibiting a lead-through on the outward side in compliance with FIG. 4 with an adjustable tension absorbing device 15 for the squared off live feeder 5, whereby the insulating mounting fixture 11 is not however necessary as the outward leading part of the live feeder 5 is held and supported in its pre-determined position by the tension absorbing device 15.

By means of the wall lead-through design for live feeders in compliance with the herewith presented invention it is possible to avoid by simple means the difficulties which were hitherto present with regard to a reduction of the dielectric strength as a result of excessive soiling of the outer surface of the insulator and the high danger of breakage of such large devices during transport.

We claim:

1. A wall lead-through structure for a live feeder which comprises a wall member having an opening therethrough, the entire wall surface defining said opening being provided with a metallic lining for corona protection, a mounting plate made from insulation material secured to one side of said wall member and covering the opening therethrough, said mounting plate being provided with a central opening coaxially aligned with the wall opening, a tubular metallic corona protector disposed within the central opening in said mounting plate and a live feeder passing through said wall opening and through said tubular corona protector.

2. A wall lead-through structure for a live feeder as defined in claim 1 and which further includes a reinforcing member for said mounting plate having a cup-shaped configuration, the bottom wall of said cup-shaped member being secured to one side of said mounting plate and being provided with a central opening in axial alignment with the central opening in said mounting plate.

3. A wall lead-through structure for a live feeder as defined in claim 1 and which further includes a tension absorbing device for providing additional support for said live feeder, said tension absorbing device being located at the wall side opposite that to which said mounting plate is located and including a plurality of tension absorbing members extending respectively between a common anchor point on said live feeder and respective anchor points on the wall adjacent the opening therethrough.

4. A wall lead-through structure for a live feeder as defined in claim 3 and wherein each of said tension absorbing members includes an insulator member interposed therein.

5. A wall lead-through structure for a live feeder as defined in claim 1 forming part of a transmission antenna system wherein said wall member is constituted by a wall dividing a matching room and a dirt collector room.

* * * * *